US005670759A

United States Patent [19]

Hsu

[11] Patent Number: 5,670,759

[45] Date of Patent: Sep. 23, 1997

[54] PUSH BUTTON SWITCH INCLUDING COMPLEMENTARY HOUSING AND ACTUATOR POLYGONAL SHAPES

[75] Inventor: Chien-Shih Hsu, Taipei, Taiwan

[73] Assignee: Acer Peripherals, Inc., Taoyuan, Taiwan

[21] Appl. No.: 502,756

[22] Filed: Jul. 14, 1995

[51] Int. Cl.[6] ..... H01H 13/70

[52] U.S. Cl. ..... 200/5 A; 200/345

[58] Field of Search ..... 200/5 A, 512–517, 200/341–345

[56] References Cited

U.S. PATENT DOCUMENTS

| | | | |
|---|---|---|---|
| 4,493,959 | 1/1985 | Viebrantz | 200/345 |
| 4,778,952 | 10/1988 | Watkins et al. | 200/5 A |
| 4,939,324 | 7/1990 | English et al. | 200/345 |
| 5,203,448 | 4/1993 | Osada et al. | 200/5 A X |
| 5,283,408 | 2/1994 | Chen | 200/345 |
| 5,324,902 | 6/1994 | Shen | 200/517 |

*Primary Examiner*—J. R. Scott
*Attorney, Agent, or Firm*—Fish & Richardson P.C.

[57] ABSTRACT

An improvement of a push button switch is provided. The improvement is characterized in that the plunger has a cross section of polygon form which contacts with the inner surface of the housing at a plurality of contact lines and a small segment of guiding surface is provided between the hook and bottom surface of the plunger for more accurate insertion of the plunger into the vertical slot of the housing.

2 Claims, 2 Drawing Sheets

PUSH BUTTON SWITCH INCLUDING COMPLEMENTARY HOUSING AND ACTUATOR POLYGONAL SHAPES

TECHNICAL FIELD OF THE INVENTION

The invention relates to a push button switch, and in particular, to a push button switch with smaller operation resistance and a more accurate assembly operation.

BACKGROUND OF THE INVENTION

The push button switch is widely used in many industrial applications, e.g. keyboard input device.

In general, a push button switch includes a key cap, a housing, an elastically deformable actuation device and membrane switch.

The key cap has a bottom surface and a plunger. The plunger extends vertically from the bottom surface and has a side surface and a bottom end.

The housing is provided to have a vertical slot with an opening. The opening is for the passage and reciprocal movement of the plunger, in response to the operation of the user on the key cap. The vertical slot has an inner surface guiding the plunger during its reciprocal movement within the housing.

The elastically deformable actuation device is received within the housing. The actuation device has an upper surface to be overlaid by the bottom end of the plunger.

A hook is provided near the bottom end of the side surface and is restrained from further upward movement by the step of the inner surface of the vertical slot of the housing when the plunger bounces upward due to the reaction force from the actuation device.

The membrane switch is for on-off control of an electric equipment, in response to a status of the actuation device.

In most designs, the key cap is not allowed to rotate substantially with respect to the housing.

Therefore, as a plunger of circular cross-section type is selected, there must be provided an anti-rotation device specially designed to prohibit the relative rotation between them. Alternatively, a plunger with cross section of general rectangular type, such as shown in FIG. 3 and 4, must be employed to prohibit the relative rotation. However, with this implementation, there are multiple frictional contact surfaces between the side surface of the plunger and the inner surface of the housing which creates more resistance while being operated by the operator.

Furthermore, during the assembly of the push button switch when the assembly force is suddenly applied, the hook ends of the plunger may not be accurately inserted into the opening of the vertical slot of the housing due to an unstable sliding phenomenon at the bearing contact of the hook end and the edge of the opening. In other words, after the forced is applied, it sometimes happened that one hook end is within the slot and another hook end is still outside the slot.

SUMMARY OF THE INVENTION

In order to solve the mentioned shortcomings of the state of arts, one object of the invention is to escalate the success of assembly process of the plunger into the housing.

Therefore, an improvement of a push button switch is provided. The improvement is characterized in that the plunger forms a cross section of polygon shape which contacts with the inner surface of the housing at a plurality of contact lines and a small segment of guiding surface is provided between the hook and bottom surface of the plunger.

Other objects and advantages of the invention will be apparent from the following detailed description of the invention together with the appended drawings.

DETAILED DESCRIPTION OF THE INVENTION

Figure 2:
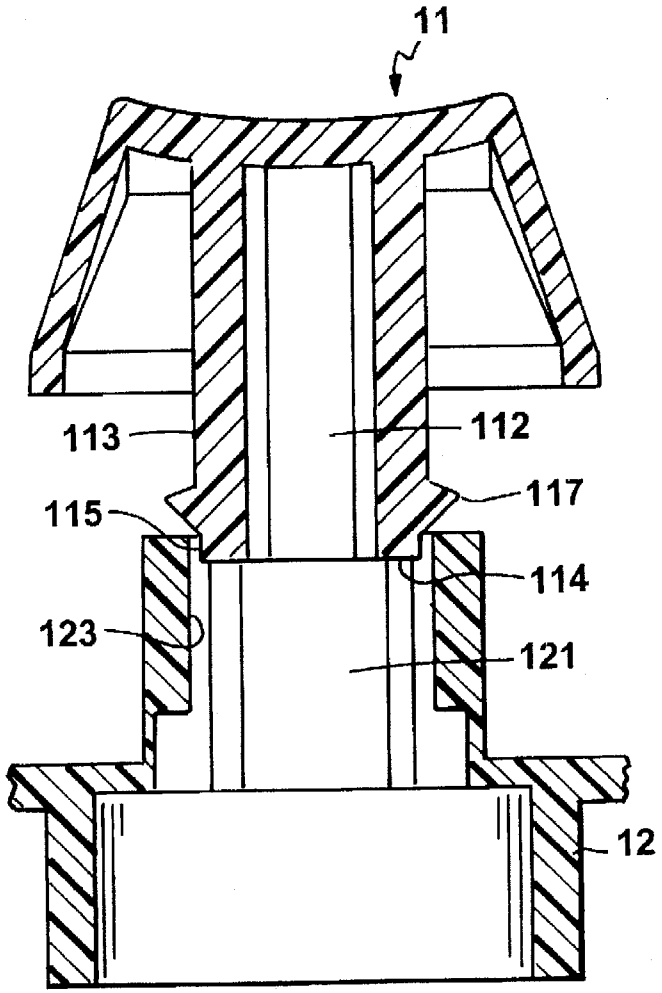
FIG. 2 shows the sectional view of the push button switch of the invention right before assembly.
Figure 1:
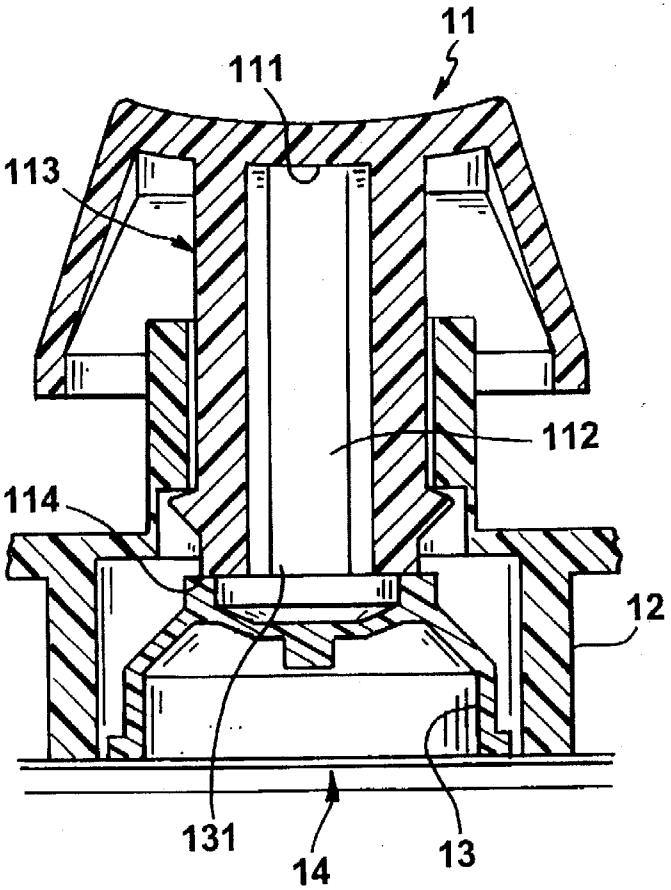
FIG. 1 shows the sectional view of the push button switch of the invention after assembly.

As shown in FIG. 1 and FIG. 2 a push button switch of the invention includes a key cap 11, a housing 12, an elastically deformable actuation device 13 and membrane switch 14.

The key cap 11 has a bottom surface 111 and a plunger 112. The plunger 112 extends vertically from the bottom surface 111 and has a side surface 113 and a bottom surface 114.

The housing 12 is provided to have a vertical slot 121 with an opening. The opening is for the passage and reciprocal movement of the plunger 112, in response to the operation of the user on the key cap 11. The vertical slot 121 has an inner surface 123.

The elastically deformable actuation device 13 is received within the housing 12. The actuation device 13 has an upper surface 131 to be overlaid by the bottom surface 114 of the plunger 112.

The membrane switch 14 is for on-off control of an electric equipment (not shown), in response to a status of the actuation device 13.

A hook 117 is provided near the bottom end of the side surface 113 and is restrained from further upward movement by the step 115 of the inner surface of the vertical slot of the housing 12 when the plunger 112 bounces upward due to the reaction force from the actuation device 13.

From FIG. 1 and FIG. 2, the improvement according to the invention is characterized in that a small segment of guiding surface 115 is provided between the hook 117 and bottom surface 114 of the plunger 112. In this way, the initial contact between the end of the plunger 112 and the entrance of the slot 121, right before the assembly force is applied, is a surface contact against a bearing contact of the conventional art. It is well known that the stability of the surface contact is better than the bearing contact. Therefore, the drawbacks of the conventional approach relating to the assembly process of the plunger into the housing is overcome by the invention.

Figure 4:
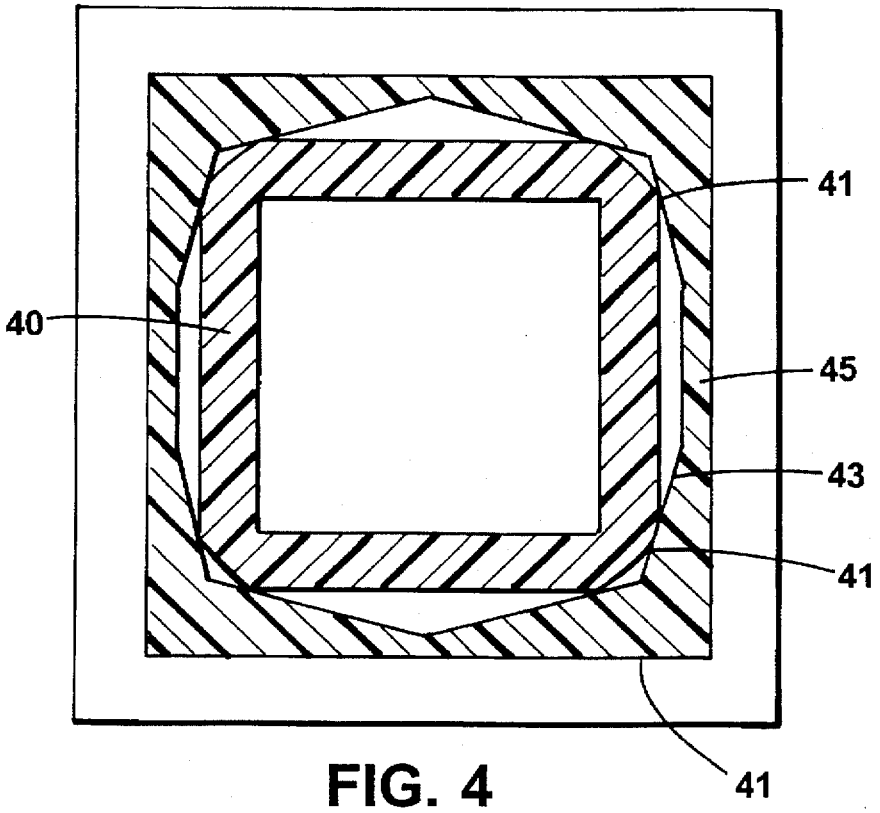
FIG. 4 shows the sectional view of the contact relationship between the plunger and inner surface of housing according to push button switch of the instant invention.

As shown in FIG. 4, the push button switch of the invention further characterizes in that the plunger 40 forms a cross section of polygon shape which contacts with the inner surface 43 of the housing 45 at a plurality of contact lines 41 to reduce the operation resistance therebetween. In one embodiment, the plunger 40 forms a cross section of a general rectangle shape with four corners chambered to form a polygon shape. In one embodiment, the inner surface of the housing forms a cross section of polygon shape with internal obtuse angles as shown in FIG. 4.

Figure 3:
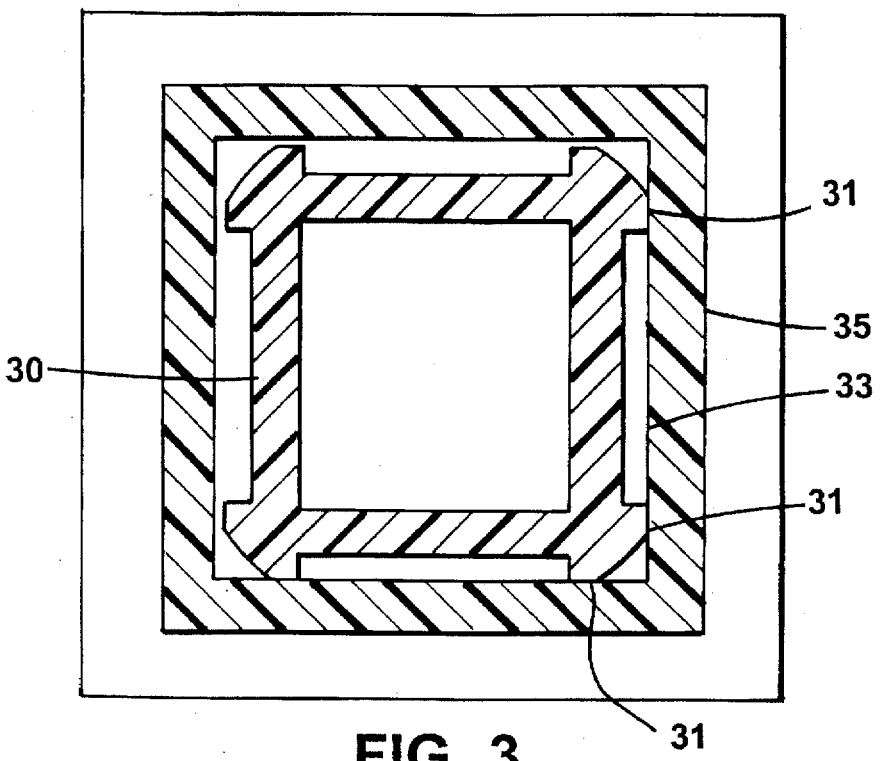
FIG. 3 (PRIOR ART)
FIG. 3 shows the sectional view of the contact relationship between the plunger and inner surface of housing according to conventional push button switch.

The conventional approach, as shown in FIG. 3, has contact surface 31 between the plunger 30 and the inner surface 33 of the housing 35. The operation resistance therebetween is obviously higher than that of the instant invention which has frictional contact of line 41 instead of surface 31.

What is claimed is:

1. A push button switch, comprising:

a key cap having a bottom surface and a plunger extending vertically from the bottom surface, the plunger having a side surface and a bottom surface, a hook being provided near a bottom end of the side surface;

a housing having a vertical slot with an opening for the passage and reciprocal movement of the plunger guided by an inner surface of the housing, the inner surface defining a polygon shape with an internal obtuse angle at each of a plurality of intersecting corners thereof along a horizontal cross section;

an elastically deformable actuation means received within the housing, the actuation means being deformed in response to the reciprocal movement of the plunger;

a membrane switch, in response to a status of the actuation means, for on-off control of an electric equipment;

said push button switch being characterized in that the side surface of the plunger defines a complementary polygon shape with an internal obtuse angle at each of a plurality of intersecting corners thereof along the horizontal cross section such that a plurality of line contacts between the side surface of the plunger and the inner surface of the housing are provided, thereby reducing operation resistance of the push button switch.

2. The switch as recited in claim 1, wherein a small segment of a guiding surface is provided between the hook and the bottom surface of the plunger for more accurate insertion of the plunger into the vertical slot of the housing through initial guiding action of the small segment within the vertical slot.

* * * * *